US005452980A

United States Patent [19]

Whiteman, Jr.

[11] Patent Number: 5,452,980

[45] Date of Patent: Sep. 26, 1995

[54] ELECTRIC LOOP WIRE BINDERY PRESS

[76] Inventor: Marvin E. Whiteman, Jr., 1175 Boeing St., Boise, Id. 83705

[21] Appl. No.: 182,481

[22] Filed: Jan. 13, 1994

[51] Int. Cl.[6] ..... B42B 5/10

[52] U.S. Cl. ..... 412/39

[58] Field of Search ..... 412/9, 22, 33, 412/38, 39

[56] References Cited

U.S. PATENT DOCUMENTS

| | | | |
|---|---|---|---|
| 3,945,073 | 3/1976 | Adams | 412/39 |
| 4,398,856 | 8/1983 | Archer et al. | 412/39 |
| 4,934,890 | 6/1990 | Flatt | 412/39 |
| 5,059,078 | 10/1991 | Schmid | 412/39 |
| 5,197,842 | 3/1993 | Bross | 412/39 |

*Primary Examiner*—Willmon Fridie
*Attorney, Agent, or Firm*—Frank J. Dykas

[57] ABSTRACT

An electrically operated binder press for pressing closed open wire loop binding wire elements which is provided with a pair of pitman arms assemblies for translating unidirectional drive shaft rotation into reciprocal pressing platen movement. A pressing platen is held in adjustable, extended, parallel orientation to the pressing bar by means of a pair of traveler adjustment screws threadably engaged through traveler blocks fixed to the ends of the press bar, and provide an adjustment means for changing the distance to which the press will compress.

5 Claims, 5 Drawing Sheets

ELECTRIC LOOP WIRE BINDERY PRESS

BACKGROUND OF THE INVENTION

1. Technical Field

This invention generally relates to an Electric Loop Wire Bindery Press for closing open-looped book binding wires, and more particularly to a bindery press which utilizes a unidirectional electric motor and pitman arm assembly to actuate the pressing mechanism.

2. Background

Open wire binding presents a number of advantages over spiral binding as a means of fastening paper for books, tablets and other uses. With open wire bindings, the pages turn more freely and are not hindered by the wire binding. Additionally, open wired binding allows greater flexibility in the amount of paper to be fastened, as the site of the wire element can be adjusted to accommodate varying amounts of paper.

In open wire binding, the pages to be bound are first punched in a die punch which perforates the pages to form either square or rectangular holes, usually at the frequency of either two or three holes to the inch. The pages are then inserted over the wire tracks of the open wire element. The open wire element, which is open in "C" shaped fashion, is then inserted in to a mechanical press, wherein an elongated platen is used to apply uniform pressure to all of the tracks of the wire elements to close them to a circular shape, thus binding the pages to form the book.

In the prior art, the binding presses are either mechanically or electrically driven. In either configuration, the binding presses incorporate an elongated pressing platen bar, which must be held and moved parallel to a fixed plate to insure that all of the loops of the wire element are uniformly pressed to a preselected, closed, diameter. Fixed slide bar guides are typically used to hold the pressing platen bar in alignment as the platen is mechanically moved up and down. Additionally, the platen bar assembly is typically permanently attached to and in fixed adjustment to the pressing linkage assembly to insure that it remains in alignment and does not bind on the guide bars. With electric presses, the prior art configurations utilize a electric bidirectional motor, which turns in one direction to move the platen pressing bar towards the stationary plat, and in the other direction to retract the platen bar. Electronic controls are utilized in conjunction with the bidirectional electric motors to adjust the length of the throw of the platen bar for varying sizes of wire elements. The binding wire elements are commonly available and utilized in the size range, ranging from 3/16 of an inch to 1 inch in diameter when closed. Hence, the travel of the bidirectional electric motor must be adjustable over a comparable range to insure its adaptability for use with varying sizes of wire elements. This results in the incorporation of expensive bidirectional motors, control systems in electric binding presses.

A bindery press assembly that utilizes a unidirectional motor and a mechanical adjustment in lieu of an adjustment in platen bar throw, would greatly simplify the press and result in a corresponding reduction in its manufacturing costs.

Accordingly, it is the object of the present invention to provide a bindery press which utilizes a unidirectional electric motor for motive power in conjunction with a cam and pitman arm assembly to convert unidirectional drive shaft rotation to a reciprocating longitudinal pressing motion for an elongated platen bar. Another object of the present invention is the incorporation of a mechanical platen bar adjustment mechanism wherein the minimum spacing between the platen bar, and the fixed plate can be adjusted thus enabling utilization of the press over the full range of available wire elements diametric sizes.

DISCLOSURE OF INVENTION

These objects are achieved in an electrically operated boundary press which is formed of a frame assembly having a planar base plate, having a pair of support posts attached to and extending normally up from the surface of the planar surface of the base plate and rigidly supporting bearing assemblies for a drive shaft which itself is in parallel alignment with the planar surface of the base plate.

Attached to the ends of the rotatable drive shaft are pitman arm assemblies formed of cam arms, or eccentric cams and pitman arms. The pitman arm assemblies are used to translate the unidirectional rotational motion of the drive shaft into a vertical up and down motion for a elongated press bar. A press bar is attached to the downwardly extending ends of the pitman arms.

A unidirectional electric motor is provided for motive rotational power for the drive shaft.

As the drive shaft is turned, the pitman arms translate the rotational motion into a reciprocal up and down pressing motion for the press bar. The throw of the reciprocal pressing motion is fixed by the length of the eccentric cams, and the distance of the press bar at its closest point of approach to the planar pressing surface is fixed by the length of the pitman arms.

Adjustments to the pressing assembly are provided by means of a pressing platen which is held in adjustable parallel alignment with the press bar by means of travelling adjustment screws which are threadably engaged through fixed traveler blocks attached to the press bar. In this manner the distance or extension of the pressing platen from the press bar can be adjusted to adjust the closest point of approach distance between the pressing platen and the planar pressing surface.

BEST MODE FOR CARRY OUT THE INVENTION

Figure 1:
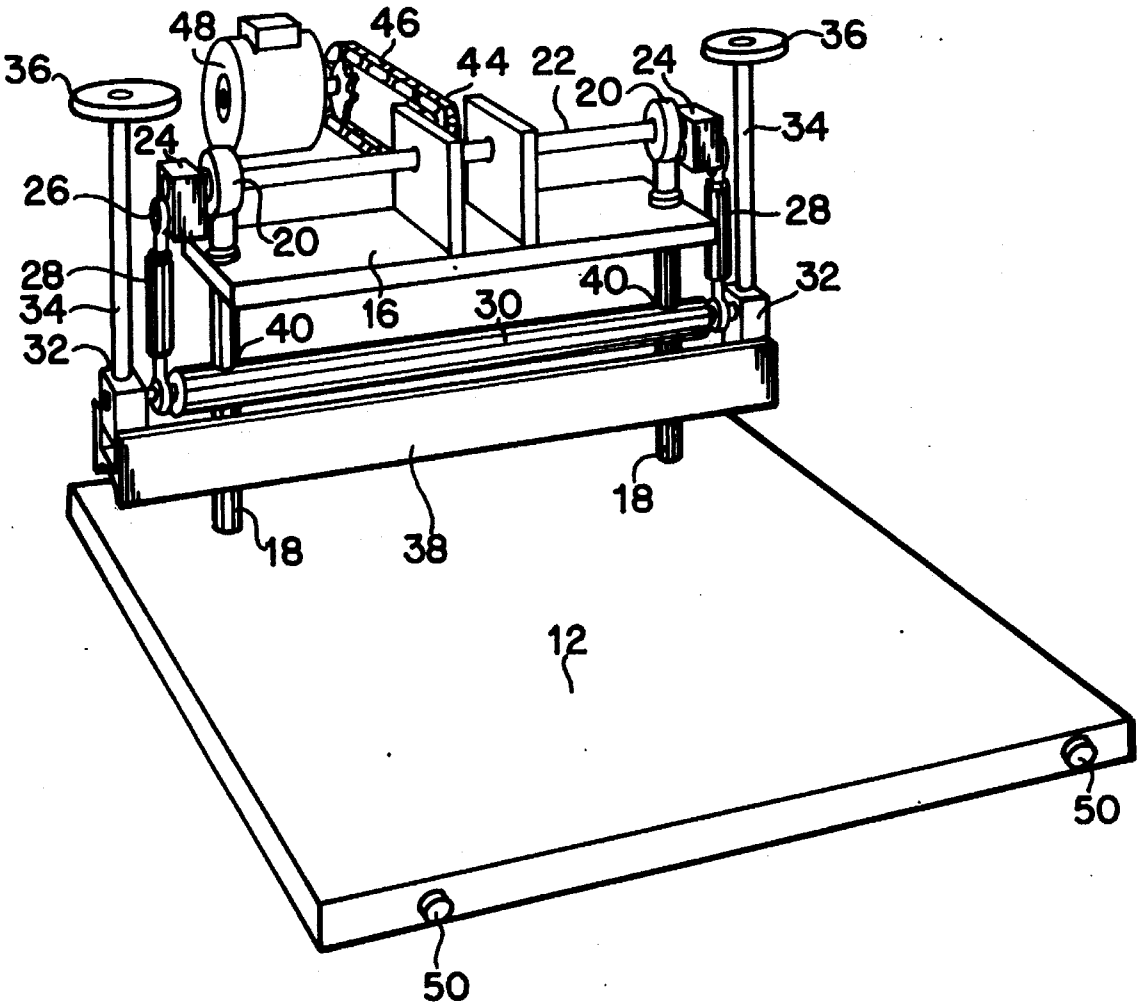
FIG. 1 is a perspective representational view of the electrically operated bindery press.
Figure 2:
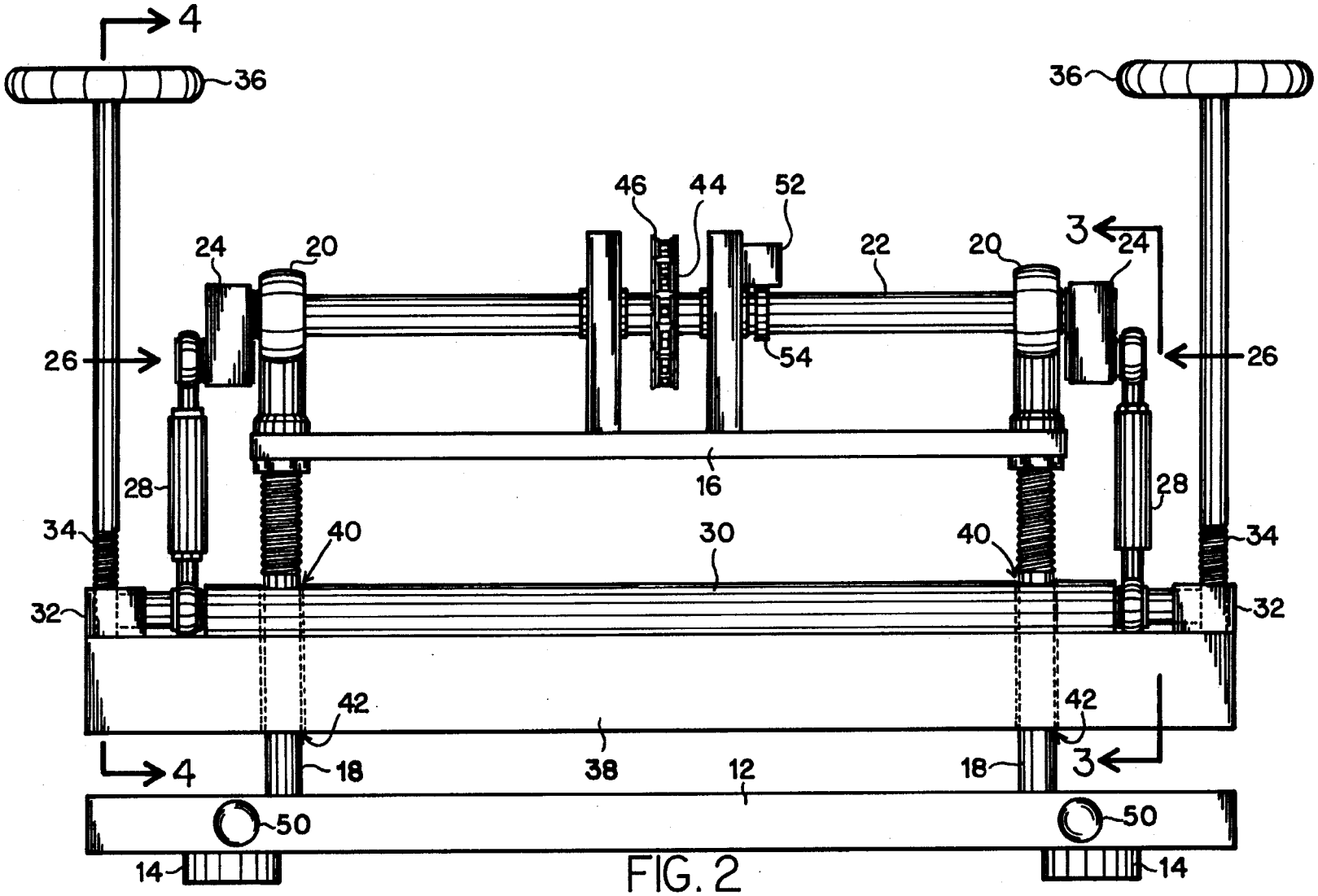
FIG. 2 is a front plan view.

First referring to FIGS. 1 and 2, there is shown my new electrically operated bindery press 10 without safety covers or shrouds. A frame assembly is formed of base plate 12, resting atop support pads 14. Support posts 18 are rigidly attached to and extend normally up from the surface of base plate 12, and are rigidly attach and support drive shaft support plate 16. In the preferred embodiment, bearing blocks 20 are extensions of support post 18 and are used to rotatably hold drive shaft 22 in fixed, parallel alignment with the surface of base plate 12.

Fixably attached to each of the ends of drive shaft 22 are cam arms 24. Cam arms 24 are closely radically aligned, one to the other on drive shaft 22 and provide motive force for the pitman arm assemblies. Extending normally out from cam arms 24 are pitman arm shafts 26. Pitman arms 28 are held rotatably attached to pitman arm shafts 26, and extend downwardly to a point below shaft support plate 16. Pitman arms 28 are used to translate the unidirectional rotational motion of drive shaft 22 into a vertical, up and down motion for press bar 30. Press bar 30 is rather stoutly constructed, and is provided with press bar guide holes 40 through which support posts 18 interfit, to hold press bar 30 in slidable alignment with the pressing surface of base plate 12.

A unidirectional electric motor 48 is provided, along with drive gear 44 attached to drive shaft 22, and drive chain 46, to provide motive force for turning shaft 22 in one direction only.

Figure 3:
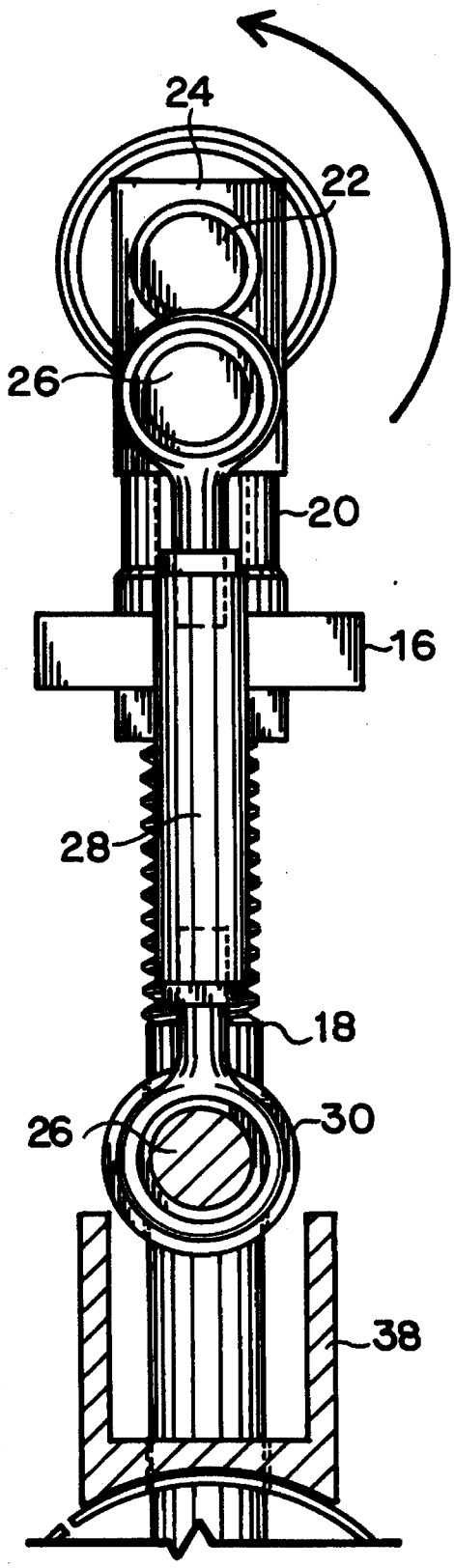
FIG. 3 is a sectional side view taken along plane three of FIG. 2.

As shown in FIGS. 1, 2 and 3, as drive shaft 22 is turned, pitman arms 28 translate the rotational movement of drive shaft 22 to a reciprocal up and down movement for press bar 30. The length of the throw, or the travel up and down of press bar 30, is determined by the length of cam arms 24. The amount of throw required to press a wire element is dependent upon the size of the diametric wire, with the largest diametric sizes requiring the largest throws. Cam arms 24 are sized to provide the necessary throw for press bar 30 to insure that it is operable for pressing the largest wire elements, usually of the diametric size of one inch.

Since the throw of press bar 30 is fixed by the length of cam arms 24, and cam arms 24 are attached to drive shaft 22, which is at a fixed distance from the surface of base plate 12, the closest point of approach of press bar 30 will be determined by the length of pitman arms 28. For that reason turnbuckle type pitman arms 28 as shown in FIGS. 1, 2 and 3, are provided for adjustably setting the distance of the closest point of approach of press bar 30 to base plate 12. If the pitman arms 28 are of unequal length, it is possible to bind against support post 18, for that reason, the adjustment of the pitman arms is to be made at the point of assembly and is not intended to be routinely changed once set.

Figure 4:
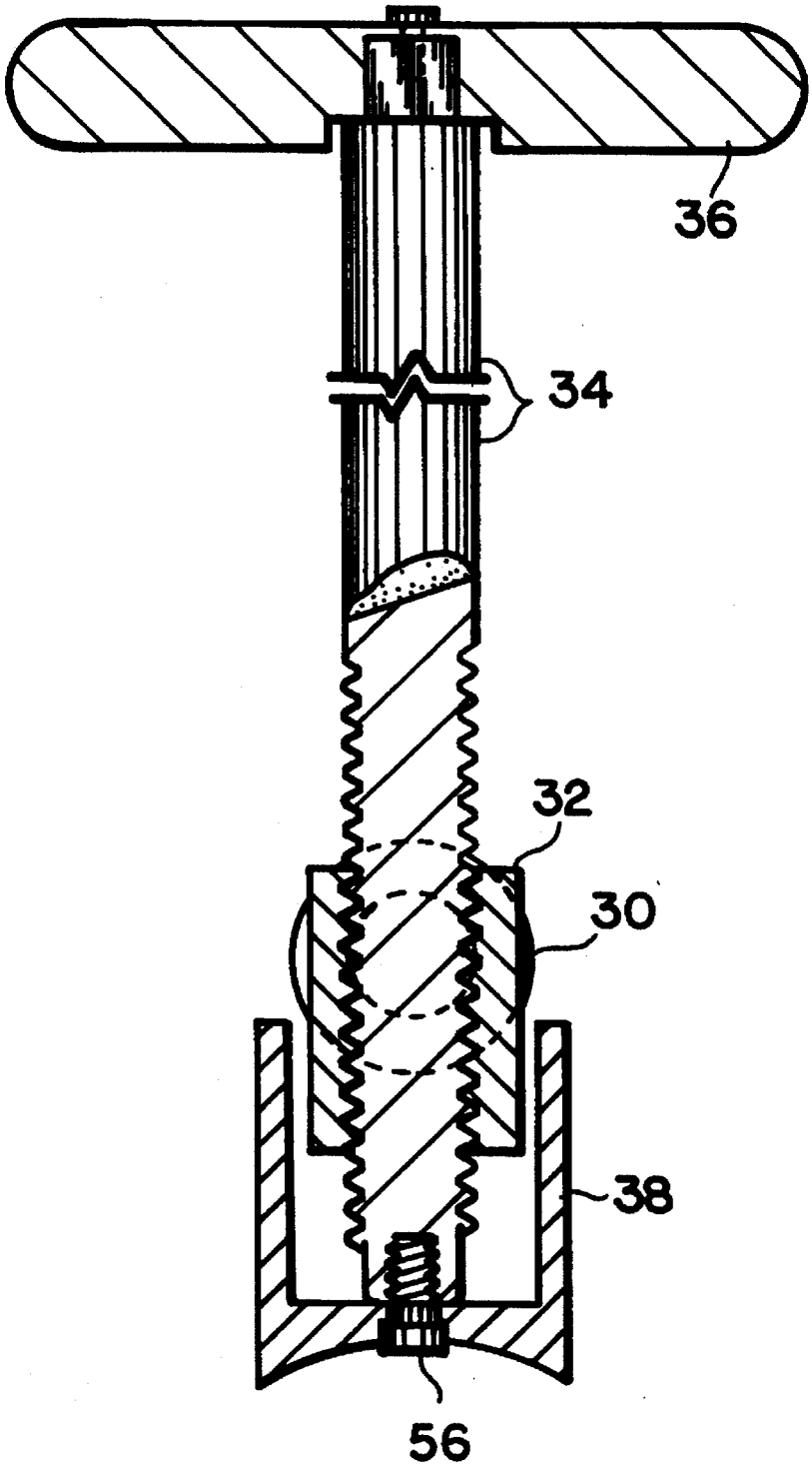
FIG. 4 is a sectional side view taken along plane four of FIG. 2.
Figure 5:
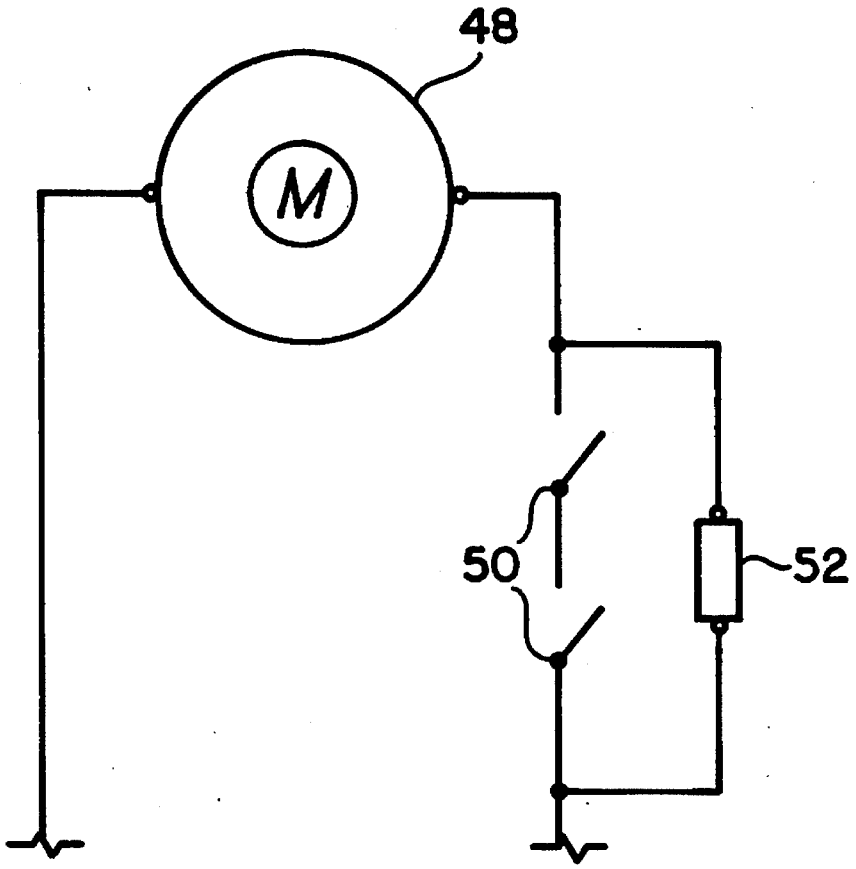
FIG. 5 is a representational schematic of the electrical control system.

It is not intended that pressing bar 30 be used as the pressing platen. Instead, press platen 38 is provided. It is held in adjustable alignment with press bar 30 by means of adjustment screws 34, which threadably engage through traveler blocks 32, which, in turn are rigidly attached to the ends of press bar 30, as can be seen in FIGS. 2 and 4.

Adjustment screws 34 are rigidly attached to press platen 38, by means of screws 56. Thus, as the operator turns knobs 36, attached to adjustment screws 34, pressing platen 38 can be extended either away from or back toward press bar 30. Thus, for an example, if the bindery press 10 is to be configured for pressing wire elements ranging in size from 3/16ths of an inch to 1 inch of closed diametric diameter, then pitman arms 28 must be initially adjusted to elevate press bar 30 to a sufficient height above base plate 12 to enable the operator to insert underneath pressing platen 38 an open a wire loom, which will close to a 1 inch diameter, and cam arms 24 must be of a sufficient length to insure that press bar 30 has a sufficient throw to close the open wire elements. To adjust bindery press 10 to close smaller wire elements, pressing platen 38 must be extended downwardly away from press bar 30. For example, if this same bindery press 10, configured to close a 1 inch diameter wire element, were to be used to close a one-half inch wire element, then pressing platen 38 must be extended downward from press bar 30 one-half inch so that at the bottom of press bar 30's throw, pressing platen 38 is not 1 inch from base plate 12, but instead is at a one-half inch distance from base plate 12. Moving pressing platen 38 will not adjust the total length of the throw, only the distance from base plate 12, at which pressing platen 38 stops its downward motion.

Figure 6:
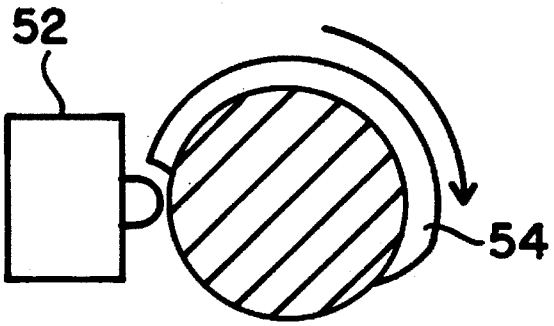
FIG. 6 is a representational schematic view of the cam operated return switch.

As can be seen in FIGS. 1, 2, 5 and 6, an electric control system is provided which incorporates the use of a pair of safety switch buttons 50, located on the front of base plate 12, to activate electric motor 48. The purpose of incorporating two safety switch buttons 50 is to insure that both hands of the operator are out from underneath pressing platen 38, during its downward stroke to close the wire loom. However, once press bar 30 has reached the bottom of its downward stroke, there is no longer a need to insure that the operator's hands are clear of pressing platen 38. For this reason, cam switch 52 is provided. Cam switch 52 provides power to electric motor 48 during the 180° of rotation of drive shaft 22 during which pitman arms 28 are travelling upwardly, raising press bar 30. This is accomplished by the use of cam 54 which is form integral with drive shaft 22. As can be seen in FIG. 6, as drive shaft 22 rotates, during the first 180° of rotation, the downward stroke of press bar 30, power is supplied to electric motor 48 through engagement of both safety switch buttons 50. However, once press bar 30 has reached the bottom of its stroke, cam 54, attached to drive shaft 22, engages cam switch 52 to provide power to electric motor 48 regardless of whether or not both safety switch button 50 are engaged, thus overriding the safety switches, and providing a steady source of power. When press bar 30 has arrived at the back of the top of its stroke cam 54 disengages from switch 52, thus interrupting power and shutting off motor 48. This feature serves at least two functions, the first is a safety function in that once the press bar 30 has reached the bottom of its stroke, bindery press 12 will automatically, without operator intervention, return to its top open position. And secondly, it enhances the efficiency of operation since it frees the operator to use his or her hands to grasp the now bound book and remove it as the press is opening.

While there is shown and described the present preferred embodiment of the invention, it is to be distinctly understood that this invention is not limited thereto but may be variously embodied to practice within the scope of the following claims.

I claim:

1. A bindery press which comprises:

a base plate having a planar pressing surface;

a plurality of support posts attached to and extending normally up from the planar surface of the base plate, said support posts adapted for rotatably holding in parallel spaced relationship to the base plate;

a drive shaft rotatably held in axial parallel relationship to the planar surface of the base plate;

a pair of eccentric cams each attached to an end of the drive shaft in radial alignment, one to the other;

a press bar slidably held in parallel spaced relationship with the planar surface of the base plate for reciprocal movement toward and away from said planar surface;

a pair of pitman arms each rotatably attached to the press bar and the eccentric portion of a cam for translating rotational movement of the eccentric cam into bi-directional movement of the press bar.

2. The bindery press of claim 1 which further comprises:

a pair of fixed traveler blocks, each attached to an end of the press bar, said traveler block adapted for receiving in threadable engagement, a travelling adjustment screw in an orientation normal to the planar surface of the base plate;

a pair of travelling adjustment screws in threadable engagement therethrough with said traveler blocks; and a elongated pressing platen disposed between the press bar and the planar surface of the base plate, attached to the ends of the travelling adjustment screws.

3. The apparatus of claim 1 which further comprises:

an unidirectional, electrically powered, motor;

means for operably connecting said electric motor to the drive shaft.

4. The apparatus of claim 3 which further comprises:

control means for selectively supplying power to the electric motor during the portion of the rotation of the drive shaft which is translated into a pressing motion of the press bar toward the planar surface of the base plate; and control means for automatically supplying power to the electric motor during the portion of the rotation of drive shaft translated into the retractive motion of press bar.

5. The apparatus of claim 4 wherein the control means for selectively applying power to the electric motor is a pair of normally open buttons switches.

* * * * *